US007895931B2

(12) United States Patent
Gaigler et al.

(10) Patent No.: US 7,895,931 B2
(45) Date of Patent: Mar. 1, 2011

(54) ELECTRO MAGNETIC COUNTERMEASURE LAUNCHER

(75) Inventors: Randy L. Gaigler, Parkville, MD (US); George Raymond Root, Jr., Gambrills, MD (US); Benjamin D. Skurdal, Bel Air, MD (US); Leszek Stanislaw Basak, Nottingham, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 948 days.

(21) Appl. No.: 11/535,480

(22) Filed: Sep. 26, 2006

(65) Prior Publication Data

US 2008/0121098 A1 May 29, 2008

(51) Int. Cl.
*F41F 1/00* (2006.01)

(52) U.S. Cl. ..... 89/8; 102/505

(58) Field of Classification Search ..... 89/1.11, 89/1.804, 1.815, 8; 102/505
See application file for complete search history.

(56) References Cited

U.S. PATENT DOCUMENTS 3,206,652 A * 9/1965 Monroe ..... 361/144
3,363,508 A * 1/1968 Stahmer ..... 89/1.818
4,222,306 A * 9/1980 Maury ..... 89/1.41
4,307,665 A * 12/1981 Block et al. ..... 102/505
4,347,463 A * 8/1982 Kemeny et al. ..... 318/135
4,432,333 A * 2/1984 Kurherr ..... 124/3
4,586,439 A * 5/1986 Wrana ..... 102/438
H357 H * 11/1987 Howland et al. ..... 89/8
4,709,615 A * 12/1987 Field ..... 89/1.56
4,791,850 A * 12/1988 Minovitch ..... 89/8
4,922,800 A * 5/1990 Hoffman ..... 89/8
4,975,606 A * 12/1990 Wu et al. ..... 310/12
5,024,137 A * 6/1991 Schroeder ..... 89/8
5,168,118 A * 12/1992 Schroeder ..... 89/8
5,217,948 A * 6/1993 Leung et al. ..... 124/3
5,269,482 A * 12/1993 Shearing ..... 244/171.7
5,294,850 A * 3/1994 Weh et al. ..... 310/13
5,452,640 A * 9/1995 Bovee et al. ..... 89/1.815
6,311,926 B1 * 11/2001 Powell et al. ..... 244/63
6,354,182 B1 * 3/2002 Milanovich ..... 89/1.818
6,361,393 B1 * 3/2002 Seymour ..... 446/34
6,696,775 B2 * 2/2004 Engel ..... 310/135
2006/0011055 A1 * 1/2006 Root, Jr. ..... 89/1.819
2007/0234893 A1 * 10/2007 Lockner et al. ..... 89/8

OTHER PUBLICATIONS

David, Michael D., "U.S. Appl. No. 12/402,989 Restriction Requirement Dec. 6, 2010", , Publisher: USPTO, Published in: US.

* cited by examiner

*Primary Examiner* — Michael Carone
*Assistant Examiner* — Michael D David
(74) *Attorney, Agent, or Firm* — DeMont & Breyer, LLC

(57) ABSTRACT

A system for launching a countermeasure device is disclosed. In the illustrative embodiment, the system uses an electromagnetic catapult to throw a countermeasure payload, wherein the azimuth, elevation, and propulsive force of the electromagnetic catapult are controllable.

22 Claims, 5 Drawing Sheets

ELECTRO MAGNETIC COUNTERMEASURE LAUNCHER

CROSS REFERENCE TO RELATED APPLICATIONS

The underlying concepts, but not necessarily the language, of the following cases are incorporated by reference:

(1) U.S. patent application Ser. No. 10/899,234, filed 26 Jul. 2004;

(2) U.S. patent application Ser. No. 11/278,988, filed 7 Apr. 2006;

(3) U.S. patent application Ser. No. 11/428,697 filed 5 Jul. 2006.

If there are any contradictions or inconsistencies in language between this application and one or more of the cases that have been incorporated by reference that might affect the interpretation of the claims in this case, the claims in this case should be interpreted to be consistent with the language in this case.

FIELD OF THE INVENTION

The present invention relates to weaponry in general, and, more particularly, to countermeasures.

BACKGROUND OF THE INVENTION

Countermeasure systems are employed by military vessels to confuse or otherwise frustrate the targeting systems of an approaching missile or similar threat. Countermeasure devices, such as flares, chaff, acoustic emitters, IR emitters, and the like, are deployed to present a false image (i.e., decoy) of the vessel to these targeting systems. The false image is presented so as to draw the threat toward the false image and, therefore, away from the actual vessel. The false image manifests sufficiently far from the actual vessel so that damage caused by the threat when it strikes the decoy is mitigated or avoided all together.

Modern missiles incorporate sophisticated sensor platforms in their targeting systems. Many of these sensor platforms are capable of sensing target signature information across a spectrum of signal types (e.g., radar, acoustic, thermal, etc.). In addition, many of these sensor platforms incorporate counter-countermeasure systems that can discriminate many countermeasure devices from an actual vessel based on the dynamic behavior of the signals it senses. It is necessary, therefore, for countermeasure systems to closely mimic the multispectral signature, shape, and behavior of an actual vessel.

Conventional countermeasure systems utilize arrays of missiles. Each missile in the array has a warhead that incorporates countermeasure devices. These systems have certain drawbacks that limit their effectiveness against relatively sophisticated sensor platforms.

One drawback relates to the limited flexibility of such systems. Specifically, the missiles in these conventional systems have a fixed position and launch angle. Furthermore, the propulsive force from the chemical propellant of each missile is not controllable. As a consequence, effective decoy placement requires that a vessel (e.g., warship, etc.) undergo complicated maneuvers prior to and after launch of the missiles.

A second drawback relates to missile signature. When the missiles launch from the countermeasure system, each chemical-propellant engine emits a characteristic signature that has thermal, aural, and visual aspects. In particular, the signature includes a thermal bloom, a cloud of smoke, noise, a thermal trail and a smoke trail. In most cases, the thermal bloom heats the area immediate to the launch area, which results in a residual local thermal signature.

A third drawback relates to countermeasure system downtime. In particular, after launch, the countermeasure launcher must be cleaned and reloaded, which renders the vessel relatively more vulnerable to attack.

Finally, in order to provide a convincing decoy, numerous countermeasure devices, including multiple device types, are required. Of course, as the complement of missiles increases, the size of the countermeasure system grows and contributes significantly to deck clutter, as well as increasing the complexity and cost of the countermeasure system.

There exists a need, therefore, for a countermeasure system that avoids or mitigates some or all of these problems.

SUMMARY OF THE INVENTION

The present invention provides a system for launching a countermeasure device that avoids some of the costs and disadvantages for doing so in the prior art. In particular, the illustrative embodiment of the present invention uses an electromagnetic catapult to throw a countermeasure device with controlled force and direction, without generating a substantial launch signature.

In the illustrative embodiment, the countermeasure system comprises an electromagnetic launch tube, which can propel a series of countermeasure payloads; a payload magazine, which can provide a plurality of payload types; and a breech loader for conveying a payload from the magazine and loading it into the launch tube.

Embodiments of the present invention comprise a countermeasure launcher that utilizes non-explosive force to precisely place multiple countermeasure devices at specific coordinates at specific times. This enables the inventive countermeasure system to generate a relatively more convincing decoy; one that is geometrically and dynamically similar to an actual vessel.

In addition to providing a more convincing decoy, the system does not generate a tell-tale launch signature that would otherwise betray the illusion created by the system. In other words, unlike conventional countermeasure systems, the present system does not generate any significant thermal, aural, or visual signature during launch.

Due to the ability to provide a more realistic decoy and a reduced launch signature compared to the prior art, embodiments of a countermeasure system disclosed herein provide an improved ability to confuse the multi-spectral sensor platforms of approaching threats. This ultimately reduces the effectiveness of the threats and improves the likelihood of survivability of the actual vessel.

The ability of the present system to control the direction, elevation, and propulsive force of the countermeasures reduces or eliminates the need for complex maneuvering by the vessel in order to develop an effective decoy. Finally, the launch of countermeasures without using explosive force eliminates the post-firing maintenance that is required by conventional hot-launch countermeasure systems. This also reduces vulnerability and improves survivability.

DETAILED DESCRIPTION

Figure 1:
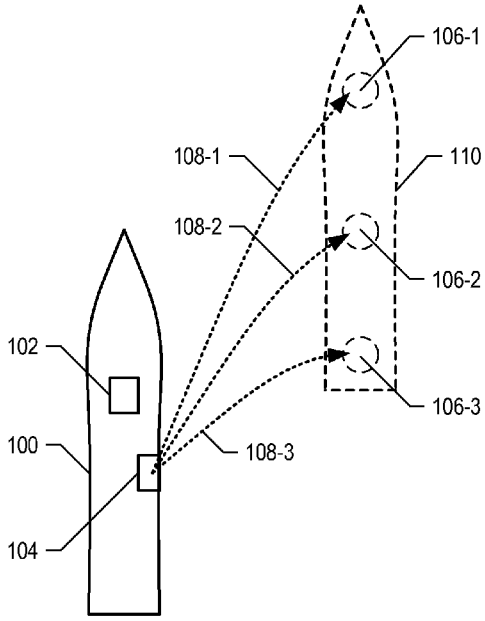
FIG. 1 depicts a schematic diagram of a warship deploying countermeasure payloads in accordance with an illustrative embodiment of the present invention.

FIG. 1 depicts a schematic diagram of a warship deploying countermeasure payloads in accordance with an illustrative embodiment of the present invention. Warship 100 carries radar tracking system 102 and countermeasure launch system 104.

Radar tracking system 102 is a system that detects and tracks potential threats and provides an estimate of their velocity and path, as is well-known in the art.

Countermeasure launch system 104 will be described in detail below and with respect to FIGS. 3 through 5.

In response to the detection of an approaching threat by radar tracking system 102, countermeasure launch system 104 launches a series of countermeasure payloads, 106-1, 106-2, and 106-3 (referred to collectively as "payloads 106"). Countermeasure payloads 106 are devices that provide an indication of the presence of a vessel to the sensors of an approaching threat by passively reflecting a signal (e.g., chaff that reflects radar signals, etc.) or actively producing a signal (e.g., flares that emit light and heat, explosives that emit acoustic and thermal energy, etc.). For the purposes of this specification, including the appended claims, the phrase "provide a signal" means either passively reflecting or actively producing a signal.

Countermeasure launch system 104 launches countermeasure payloads 106-1, 106-2, and 106-3 on paths 108-1, 108-2, and 108-3, respectively, so as to coordinate the timing of their deployment at a distance from warship 100. In some cases, it is desirable to have payloads 106 deploy simultaneously at the position of decoy 110. In some embodiments, the deployment of payloads 106 is based upon the type and path of the incoming threat.

Countermeasure launch system 104 deploys payloads 106 to their intended coordinates, each at a specific time, so that they collectively provide an image of decoy 110 to the sensors of an approaching threat. In some embodiments of the present invention, countermeasure payloads, 106-1, 106-2, and 106-3 provide signals of different types in order to frustrate and/or confuse a multi-spectral sensor capability of an incoming threat. Although the illustrative embodiment comprises three types of countermeasure payloads, it will be clear to those skilled in the art, how to make and use alternative embodiments of the present invention that comprise any number of countermeasure payload types. In various embodiments, countermeasure payloads, 106-1, 106-2, and 106-3 comprise, for example, countermeasure devices that are:

i. thermal devices; or
ii. acoustic devices; or
iii. infrared-emitting devices; or
iv. chaff; or
v. explosives; or
vi. radar reflecting; or
vii. flash-bang devices; or
viii. any combination of i through vii.

Figure 2:
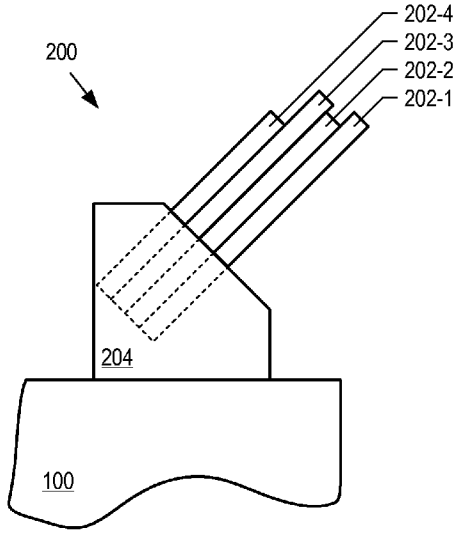
Figure 2 (Prior Art)
FIG. 2 depicts a schematic drawing of a prior-art countermeasure launcher.

FIG. 2 depicts a schematic diagram of prior-art countermeasure launcher 200. Launcher 200 comprises launch tubes 202-1, 202-2, 202-3, and 202-4 and platform 204.

Launch tubes 202-1, 202-2, 202-3, and 202-4 (referred to collectively as "launch tubes 202") are conventional countermeasure launch tubes, suitable for launching countermeasure payloads using a chemical-propellant, such as black-powder explosives. Typically, launch tubes 202 accept pre-loaded countermeasure canisters and locate them in a pre-arranged configuration.

Platform 204 is a substantially rigid structure for holding launch tubes 202. Typically, platform 204 is attached to the deck of warship 100 using means such as bolts, welding joints, etc. Typically, launch tubes 202 are rigidly held in platform 204.

Launch tubes 202 are arrayed to deploy a plurality of countermeasure devices at some distance from a warship. In the prior-art, complicated maneuvering of warship 100 is typically required for the deployment of these countermeasures. Such maneuvers are required since prior-art countermeasure launchers do not have the capability for controlled launch trajectory and/or launch energy.

In addition, the use of a chemical-propellant to propel payloads from launch tubes 202 requires extensive maintenance, such as cleaning and reloading, after each use. Warship 100 is more vulnerable to attack during this maintenance period. A prior-art countermeasure system may have as many as twelve launch tubes, thus the period of increased vulnerability can be undesirably long.

The use of a chemical-propellant to propel countermeasure payloads also increases the visibility of warship 100 to an approaching threat. Explosives create a thermal signature, a visible signature (e.g., smoke, flash, etc.), and a thermal signature. Each of these signatures increases the likelihood that warship 100 will be successfully targeted by the incoming threat. In addition, the thermal signature from a chemical-propellant launch can provide a residual signal on which the approaching threat can register long after the countermeasure payload has been launched.

Figure 3:
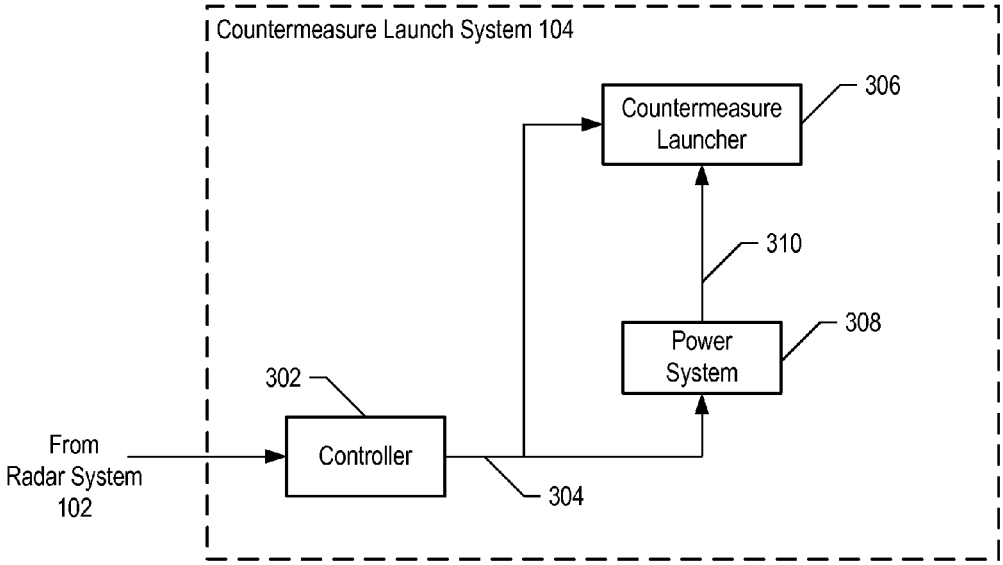
FIG. 3 depicts a schematic diagram of a countermeasure launch system in accordance with the illustrative embodiment of the present invention.

FIG. 3 depicts a schematic diagram of a countermeasure launch system in accordance with the illustrative embodiment of the present invention. Countermeasure launch system 104 is a system that has the capability to launch a payload upon command. The system expels the payload from a launch tube using an electromagnetic catapult and without the aid of explosive force. This is advantageous because the payload is launched without a substantial launch signature, thereby avoiding some of the problems discussed in the Background section. Advantageously, this enables a countermeasure payload to be deployed at desired coordinates at a desired time, and without an indication of the payload's origin. Countermeasure launch system 104 comprises controller 302, countermeasure launcher 306, and power system 308.

Controller 302 is a general purpose controller for receiving signals and information from radar system 102 and providing targeting information and firing control signals to countermeasure launcher 306 and power system 308. It will be clear to those skilled in the art, after reading this specification, how to make and use controller 302.

Countermeasure launcher 306 is a countermeasure launcher which uses an electromagnetic force to propel countermeasure payloads. The propulsive force, azimuth, and elevation of countermeasure launcher 306 are controllable to enable it to propel a countermeasure payload to any desired point within its range. Although the illustrative embodiment comprises a countermeasure launcher that uses electromagnetic force to propel countermeasure payloads, it will be clear to those skilled in the art, after reading this specification, how to make and use alternative embodiments of the present invention that utilize other "cold-launch" (non-chemical-based) technologies to propel countermeasure payloads.

In some alternative embodiments, countermeasure launcher 306 comprises at least one launch tube that utilizes non-explosive propulsive force for launching countermeasure payloads and at least one launch tube that utilizes explosive propulsive force for launching countermeasure payloads. Countermeasure launcher 306 is described in more detail below and with respect to FIGS. 4 and 5.

Control cable 304 carries signals and control information from controller 302 to countermeasure launcher 306 and power system 308.

Power system 308 comprises circuitry that conditions and manages the storage and delivery of power to countermeasure launcher 306 in response to signals from controller 302. Power system 308 controls power generation, storage, and delivery prior to, during, and after each launch. Power system 308 provides an amount of power to countermeasure launcher 306 suitable to enable it to propel a countermeasure payload on its desired path (e.g., one of paths 108-1, 108-2, or 108-3). It will be clear to those skilled in the art, after reading this specification, how to make and use power system 308.

Current cable 310 carries power from power system 308 to countermeasure launcher 306. In some embodiments of the present invention that comprise multiple electromagnetic launch tubes, current cable 310 is capable of carrying power to each electromagnetic launch tube independently from the other electromagnetic launch tubes.

Figure 4:
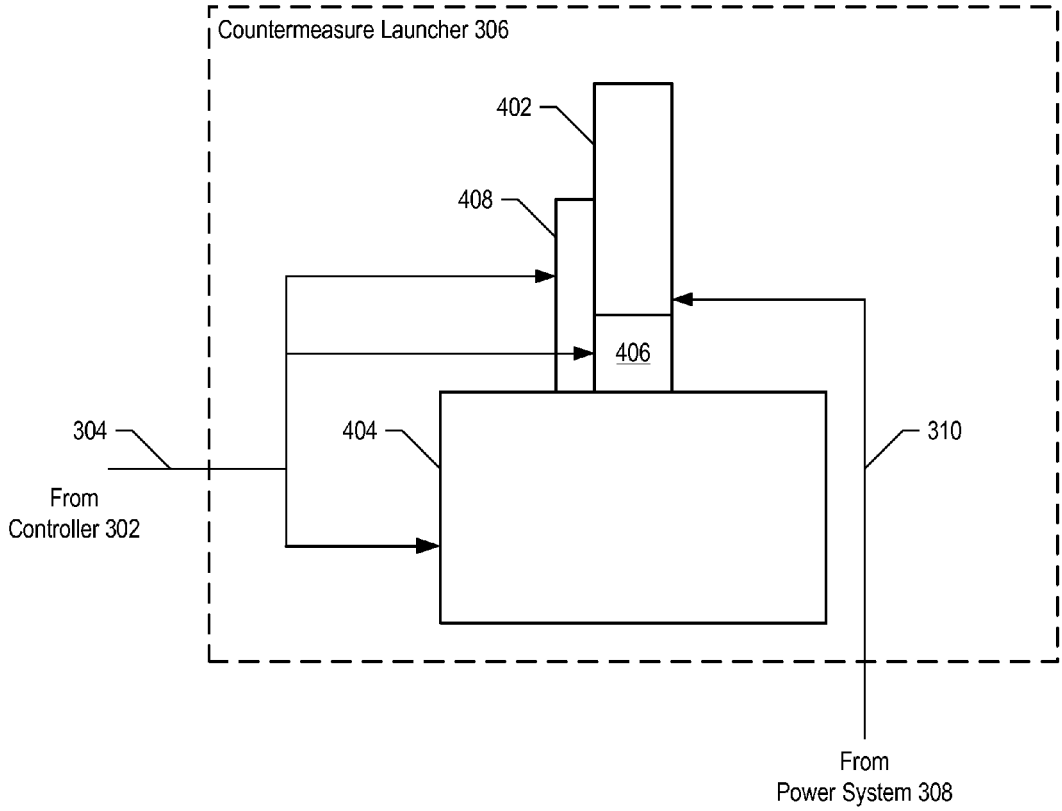
FIG. 4 depicts a schematic diagram of a countermeasure launcher in accordance with the illustrative embodiment of the present invention.

FIG. 4 depicts a schematic diagram of a countermeasure launcher in accordance with the illustrative embodiment of the present invention. Countermeasure launcher 306 comprises electromagnetic launch tube 402, magazine 404, breech loader 406, and alignment controller 408.

Launch tube 402 is a countermeasure launch tube which uses an electromagnetic force to propel countermeasure payloads. Launch tube 402 will be described in more detail below and with respect to FIG. 5.

Magazine 404 is a countermeasure payload magazine that holds and contains a plurality of countermeasure payload types. It will be clear to those skilled in the art, after reading this specification, how to make and use magazine 404.

Breech loader 406 is a system for conveying a countermeasure payload from magazine 404 to launch tube 402. In response to commands from controller 302, breech loader 406 works in concert with magazine 404 and launch tube 402 to select and provide a countermeasure payload to the launch tube. It will be clear to those skilled in the art, after reading this specification, how to make and use breech loader 406.

Alignment controller 408 is a system for aligning launch tube 402 such that a countermeasure payload is propelled in a desired direction and at a desired launch angle. Alignment controller 408 aligns launch tube 402 in response to signals from controller 302. It will be clear to those skilled in the art, after reading this specification, how to make and use alignment controller 408. In some embodiments of the present invention, alignment controller controls only one of the azimuth and elevation of launch tube 402.

Control of the azimuth and elevation of launch tube 402 for each payload, in addition to control of the force used to propel the payload enables the placement of multiple countermeasure payloads:

i. at different coordinates at the same time; or
ii. at the same coordinates at the same time; or
iii. at the same coordinates at different times; or
iv. at different coordinates at different times; or
v. any combination of i, ii, iii, and iv.

As a result, embodiments of the present invention provide control over the configuration, position, and dynamics of decoy 110.

Figure 5:
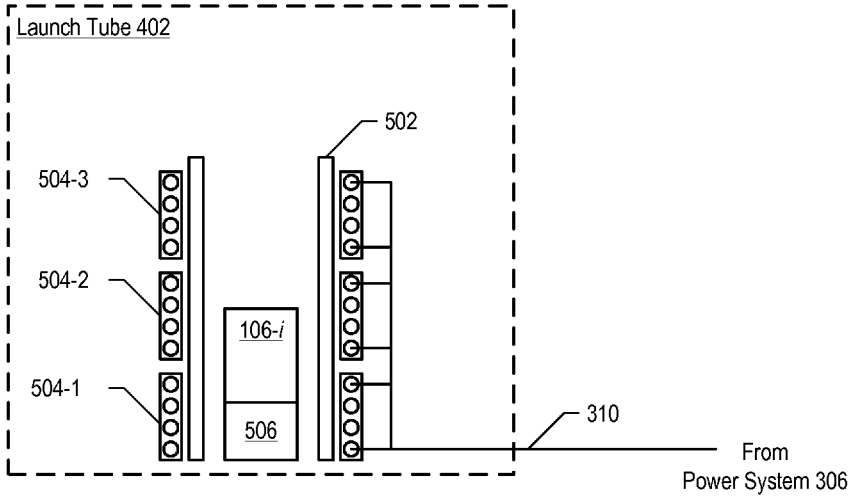
FIG. 5 depicts a schematic diagram of a launch tube in accordance with the illustrative embodiment of the present invention.

FIG. 5 depicts a schematic diagram of a launch tube in accordance with the illustrative embodiment of the present invention. Launch tube 402 comprises tube 502, propulsion coils 504-1 through 504-3, and armature 506.

Tube 502 is a cylindrical tube that has sufficient interior diameter to accommodate the largest countermeasure payload suitable for countermeasure launcher 306. Tube 502 has sufficient strength to withstand the forces exerted on tube 502 during a countermeasure payload launch.

Each of propulsion coils 504-1 through 504-3 (referred to collectively as "coils 504") is a length of electrical conductor that is suitable for carrying sufficient electric current to accelerate armature 506. The propulsive force provided by each of coils 504 to armature 506 is a function of the number of turns it contains, the current it carries, and the separation between it and armature 506.

Armature 506 is a rigid platform suitable for holding countermeasure payload **106-*i*, wherein i is a positive integer in the set $\{1, \ldots 3\}$, and developing a mutual inductance with a magnetic field generated by the flow of current in any of coils 504. Armature 506 typically comprises a magnetic material such as iron, steel, Permalloy, etc. The magnitude of the force directed on armature 506 is a function of the mutual inductance between armature 506 and coils 504. In some embodiments, armature 506 comprises a non-magnetic material and an armature coil, and the magnitude of the force directed on armature 506 is a function of the mutual inductance of this armature coil and coils 504. It will be clear to those skilled in the art, after reading this specification, how to make and use armature 506**.

Figure 6:
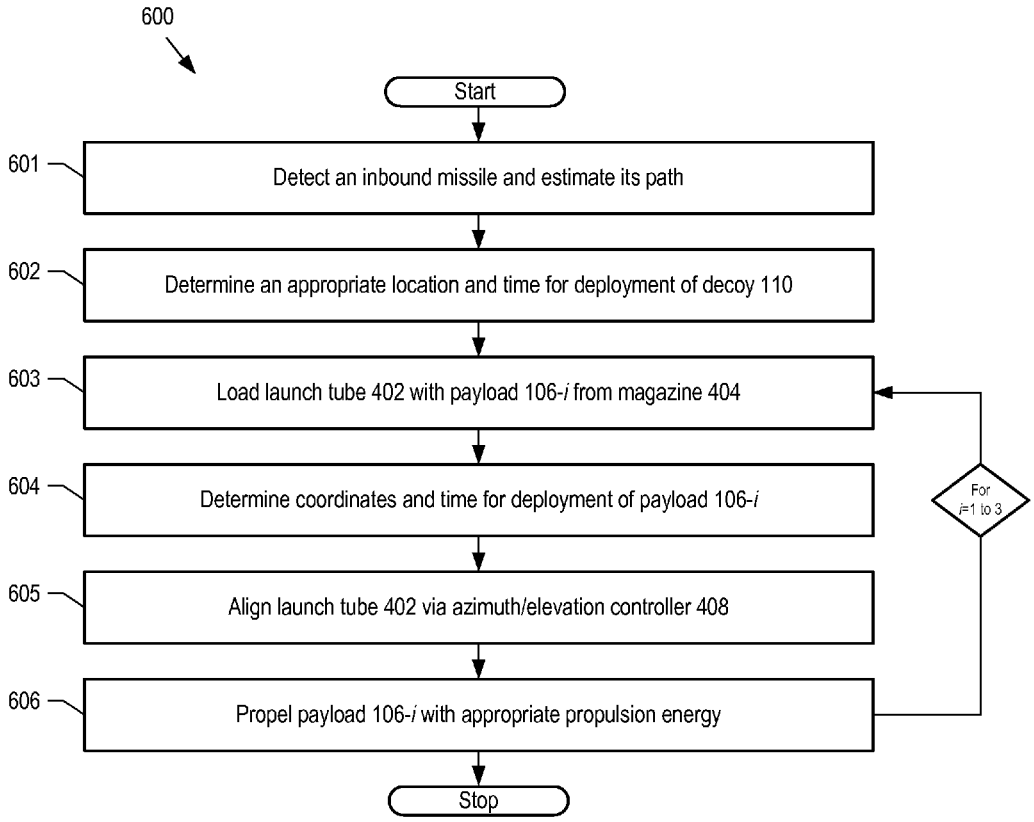
FIG. 6 describes a representative countermeasure deployment in accordance with the illustrative embodiment of the present invention.

FIG. 6 describes a representative countermeasure deployment in accordance with the illustrative embodiment of the present invention.

Representative countermeasure deployment 600 begins at task 601, wherein an approaching threat, an inbound missile in this example, is detected by radar system 102. Radar system detects the inbound missile and estimates its path, and this information is provided to controller 302.

At task 602, controller 302 determines an appropriate location and time at which to form decoy 110.

At task 603, breech loader 406 conveys payload 106-1 from magazine 404 and loads payload 106-1 into launch tube 402.

At task 604, controller 302 determines the coordinates and time at which payload 106-1 should be deployed and provides them to alignment controller 408.

At task 605, alignment controller 408 sets the azimuth and elevation of launch tube 402.

At task 606, power system 308 sequences electric current to coils 504-1 through 504-3 to propel payload 106-1 with the appropriate force for deploying payload 106-1 at its specified coordinates at the specified time.

Countermeasure deployment 600 repeats tasks 603 through 606 for each of payloads 106-2 and 106-3, thereby forming complete decoy 110.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. An apparatus comprising a first launcher, wherein said first launcher is physically-adapted to generate a propulsive force for propelling each of a series of payloads from a launch tube, wherein said propulsive force is controllable, and wherein the azimuth of said first launcher is variably-controllable, and further wherein the elevation of said first launcher is variably-controllable;

wherein said controllable propulsive force, controllable azimuth, and controllable elevation of said first launcher enable said launcher to produce a coordinated pattern of payloads at a distance from said first launcher.

2. The apparatus of claim 1 wherein said coordinated pattern is coordinated temporally.

3. The apparatus of claim 2 wherein said first launcher comprises an electromagnetic propulsion system, and wherein said electromagnetic propulsion system generates said propulsive force.

4. The apparatus of claim 1 wherein said coordinated pattern is coordinated spatially.

5. The apparatus of claim 1 wherein said propulsive force is generated electrically.

6. The apparatus of claim 1 further comprising said payload, wherein said payload comprises an element for providing a signal at a distance from said launcher.

7. The apparatus of claim 1 further comprising a magazine for providing said payload to said launcher.

8. The apparatus of claim 1 further comprising a second launcher for propelling a payload.

9. An apparatus comprising a launcher for propelling a payload that is physically-adapted to provide a signal at a distance from said launcher, wherein said launcher generates a non-explosive force for propelling said payload, and wherein said non-explosive force is controllable.

10. The apparatus of claim 9 wherein said launcher comprises an electromagnetic propulsion system, and wherein said electromagnetic propulsion system provides said non-explosive force.

11. The apparatus of claim 9 wherein said launcher comprises a physical adaptation for controlling at least one of the azimuth and the elevation of said launcher.

12. The apparatus of claim 9 further comprising a magazine for providing said payload to said launcher.

13. The apparatus of claim 12 wherein said magazine comprises a physical adaptation for providing any one of a plurality of payload types, and wherein said payload is selected from said plurality of payload types.

14. An apparatus comprising a launcher for propelling a series of payloads from a launch tube, wherein said launcher generates a propulsive force for propelling each payload in said series, and wherein said propulsive force does not generate a substantially detectable launch signature.

15. The apparatus of claim 14 wherein said propulsive force is controllable.

16. The apparatus of claim 14 wherein said launcher comprises a first physical-adaptation for controlling the azimuth and the elevation of said launcher.

17. The apparatus of claim 14 wherein said launcher is suitable for launching any of a plurality of payload types.

18. The apparatus of claim 17, wherein said propulsive force is controllable, and wherein said launcher comprises a first physical-adaptation for controlling the azimuth and the elevation of said launch tube, and further wherein said apparatus further comprises a controller for controlling at least one of said propulsive force, said payload type, the azimuth of said launch tube, and the elevation of said launch tube.

19. The apparatus of claim 14 wherein said propulsive force is a non-explosive force.

20. The apparatus of claim 14 wherein said propulsive force is an electrically-generated force.

21. The apparatus of claim 14 wherein said launcher comprises an electromagnetic launch system, and wherein said electromagnetic launch system propels each payload in said series.

22. The apparatus of claim 14, wherein each of said series of payloads comprises an element for providing a signal at a distance from said launcher.

* * * * *